US005147278A

United States Patent [19]

Demura et al.

[11] Patent Number: 5,147,278

[45] Date of Patent: Sep. 15, 1992

[54] AIR SEPARATION METHOD AND APPARATUS FOR PLEATING A PLASTIC FILM WEB

[75] Inventors: Michael Demura, Sterling; James LaCombe; Roger A. Novak, both of Bay City; Raymond D. Barta, Midland, all of Mich.

[73] Assignee: DowBrands L.P., Indianapolis, Ind.

[21] Appl. No.: 414,844

[22] Filed: Sep. 29, 1989

[51] Int. Cl.[5] ..... B65H 45/08

[52] U.S. Cl. ..... 493/439; 493/443

[58] Field of Search ..... 493/256, 314, 410, 418, 493/439, 443

[56] References Cited

U.S. PATENT DOCUMENTS

| | | | |
|---|---|---|---|
| Re. 28,959 | 9/1976 | Naito | 425/326.1 |
| 2,631,332 | 3/1953 | Reber | 493/450 |
| 3,191,926 | 6/1965 | Ramaika | 493/418 |
| 3,566,756 | 3/1971 | Schmid | 493/439 |
| 3,618,478 | 11/1971 | Piazze | 493/194 |
| 4,421,501 | 12/1983 | Scheffer | 493/439 |
| 4,462,779 | 7/1984 | Brinkmeier et al. | 425/140 |
| 4,468,213 | 8/1984 | Termaat | 493/256 |
| 4,578,051 | 3/1986 | Everman | 493/439 |
| 4,666,423 | 5/1987 | Herrington | 493/439 |
| 4,767,391 | 8/1988 | Jensen | 493/256 |
| 4,915,680 | 4/1990 | Nestle et al. | 493/417 |

*Primary Examiner*—William E. Terrell

[57] ABSTRACT

An apparatus and method for introducing a pleat into an advancing folded-over film web is provided which utilizes air under low pressure to separate the opposing faces of the web prior to the pleat being made. By unblocking the faces of the folded-over web, the web may be readily advanced and pleated without hang ups, misalignment, or tearing of the web. The apparatus includes a pair of substantially aligned and spaced-apart receiving plates over which opposing faces of the film web pass, a generally circular wheel positioned between the receiving plates and extending into the space therebetween for forming a pleat in the folded-over film, and an air passage positioned between the receiving plates for directing a flow of air between the opposing faces of the film web to separate the opposing faces of the web prior to passing over the receiving plates.

12 Claims, 2 Drawing Sheets

AIR SEPARATION METHOD AND APPARATUS FOR PLEATING A PLASTIC FILM WEB

BACKGROUND OF THE INVENTION

This invention relates to a method and apparatus for forming a pleat in a continuous film web, and more particularly to a method and apparatus for using pressurized air to separate opposing faces and unblock a folded web prior to forming a pleat.

Gusseted plastic bags are typically manufactured from a substantially continuous web of a thermoplastic film which has been folded over onto itself to form a U-folded web. While single ply layers are typical, additional plies of plastic, each comprising one or more thermoplastic materials, may be used to form laminated webs. The edges of the web opposite the U-folded portion may also have complementary closure profiles (i.e., zippers) thereon.

A pleat is formed in the film web when the U-folded edge portion is again tucked or folded inwardly upon itself to form a gusset fold along that edge portion of the web. Numerous gusset configurations are possible including bi-folded and tri-folded gussets. The film web is then heat sealed and severed transversely to form individual gusseted bags. Upon the filling of such gusseted bags with a solid or liquid, the gusset folds expand to form a base of a dimension equivalent to the width of the tucks or folds which were made. Gusseted plastic bags possess an advantage over nongusseted bags in that they are self-supporting and remain upright when filled.

There are many gusseting apparatuses available in the prior art including, for example, Piazze, U.S. Pat. No. 3,618,478, which relates to the gusseting of an open-ended web. A typical apparatus includes a pair of generally aligned, closely-spaced plates positioned inside the film web and contiguous with the interior faces of the folded-over edge portion of the web. Another plate, preferably in the shape of a wheel, is positioned a predetermined distance between the closely-spaced plates but on the exterior surface of the folded-over edge to urge that edge inward to form the pleat in the web which ultimately becomes the gusset.

In the past, problems have arisen in the formation of the pleats in the U-folded webs as those webs were driven through the pleating apparatus. The U-folded film web is provided typically in a condition in which the two opposing faces of the film are flattened against each other due to the nip roll pairs which are used to drive the web through the apparatus. The surfaces of the opposing faces of such folded webs tend to block to each other (i.e., stick together to an extent that they are not easily separated). During high speed formation of the pleat, the blocked web may not open up over the spaced apart plates rapidly enough to permit the proper tuck to be taken in the web by the opposing gusseting wheel. Additionally, the web may hang up on the plates, and misalignment and tears to the web may result.

Accordingly, the need exists in the art to provide a method and apparatus by which the web may be rapidly pleated, but without the misalignment and tearing problems associated with previous pleating methods and apparatuses.

SUMMARY OF THE INVENTION

The present invention meets that need by providing an apparatus and method for introducing a pleat into an advancing folded-over film web which utilizes air under low pressure to separate the opposing faces of the web prior to the pleat being made. By unblocking the faces of the folded-over web, the web may be readily advanced and pleated without hang ups, misalignment, or tearing of the web.

In accordance with one aspect of the invention, an apparatus for introducing a pleat into an advancing, substantially continuous, folded-over web of plastic film is provided which includes a pair of substantially aligned and spaced-apart receiving plates over which opposing faces of the film web pass. The apparatus also includes means positioned between the receiving plates and extending into the space therebetween for forming a pleat in the folded-over film. Preferably, this means is a generally circular-shaped wheel. Finally, the apparatus includes means positioned between the receiving plates for directing a flow of air between the opposing faces of the film web to separate the opposing faces of the web prior to passing over the receiving plates.

The apparatus also may include a pair of nip rolls positioned downstream from the receiving plates for expelling air from the web, which was introduced to unblock the opposing faces of the web prior to pleating, and for flattening the web for further processing such as severing the web into individual bags.

In a preferred embodiment of the invention, the means for directing the flow of air comprises a source of air under pressure and means for supplying the air to the area between the receiving plates. Also provided are means for supporting the receiving plates in a spaced apart position, which may comprise a support bar. The support bar includes an orifice therethrough for supplying air to the area between the receiving plates. Preferably, the end of the orifice in the support bar directs air upstream toward the opposing faces of the advancing film web.

In a preferred embodiment of the invention, zippered film is utilized. The apparatus introduces a pleat into an advancing, substantially continuous, folded-over web of plastic film having a zipper with rib and groove profiles on opposing faces thereof and includes a pair of substantially aligned and spaced-apart receiving plates over which the opposing faces of the film web pass. The apparatus also includes means positioned between the receiving plates and extending into the space therebetween for forming a pleat in the folded-over film. This means for forming a pleat preferably comprises a generally circular-shaped wheel. The apparatus may also include means for laterally aligning the zipper during pleating of the web and means positioned between the receiving plates for directing a flow of air between the opposing faces of the film web to separate the opposing faces of the web prior to passing over the receiving plates.

Preferably, the means for directing the flow of air comprises a source of air under pressure and means for supplying the air to the area between the receiving plates. The apparatus further includes means for supporting the receiving plates in a spaced apart position such as a support bar. The support bar includes an orifice therethrough for supplying air to the area between the receiving plates, and the end of the orifice in the support bar preferably directs air upstream toward the opposing faces of the advancing film web.

The present invention also provides a method for introducing a pleat into an advancing, substantially continuous, folded-over web of plastic film comprising the steps of advancing opposing faces of the film web over a pair of substantially aligned and spaced-apart receiving plates, directing a flow of air between the opposing faces of the film web to separate the opposing faces of the web prior to passing over the receiving plates, and forming a pleat in the folded-over web of film by tucking the edge of the folded-over web inwardly between the receiving plates. The flow of air is delivered at a rate which will unblock the opposing faces of the advancing film web, but does not have to completely inflate the web. A preferred rate of supply is at least about 0.5 $ft^3$/minute, but may vary depending upon several factors including the rate at which air leaks out of the web around the support bar.

In the preferred embodiment of the invention in which zippered film is utilized, the present invention provides a method for introducing a pleat into an advancing, substantially continuous, folded-over web of plastic film having a zipper with rib and groove profiles. That method includes the steps of advancing opposing faces of the film web over a pair of substantially aligned and spaced-apart receiving plates, directing a flow of air between the opposing faces of the film web to separate the opposing faces of the web prior to passing over the receiving plates, and forming a pleat in the folded-over web of film by tucking the edge of the folded-over web inwardly between the receiving plates while maintaining the zipper in lateral alignment. Again, the flow of air should be delivered at a rate which will unblock the opposing faces of the advancing film web, but does not have to completely inflate the web. A preferred rate of supply is at least about 0.5 $ft^3$/minute.

Accordingly, it is an object of the present invention to provide an apparatus and method for introducing a pleat into an advancing folded-over film web which utilizes air under low pressure to separate the opposing faces of the web prior to the pleat being made, thereby permitting the web to be readily advanced and pleated without hang ups, misalignment, or tearing of the web. This, and other objects and advantages of the present invention, will become apparent from the following detailed description, the accompanying drawings, and the appended claims.

DETAILED DESCRIPTION OF THE PREFERRED EMBODIMENTS

Figure 1:
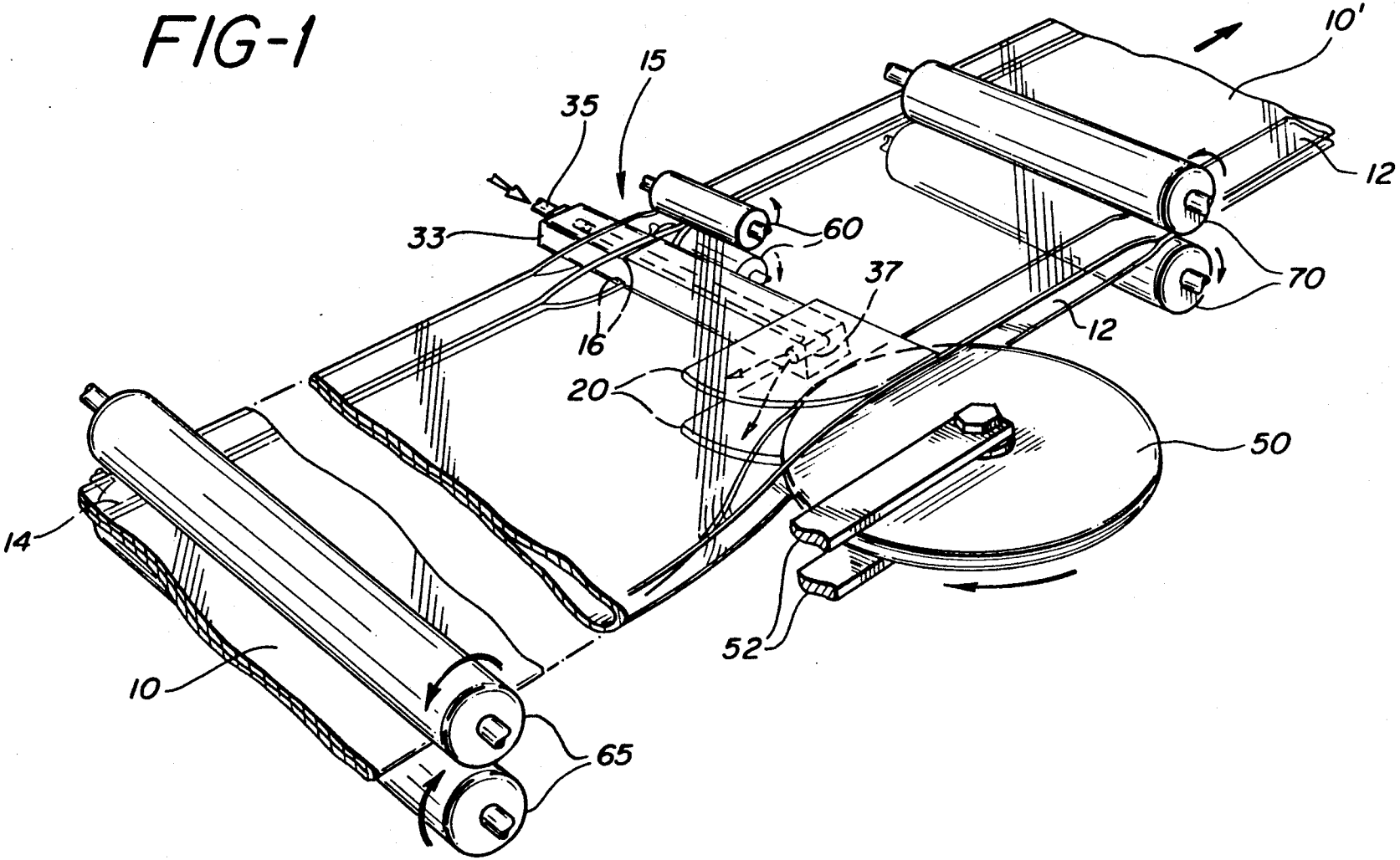
FIG. 1 is a fragmentary perspective view of an apparatus in accordance with the present invention.
Figure 2:
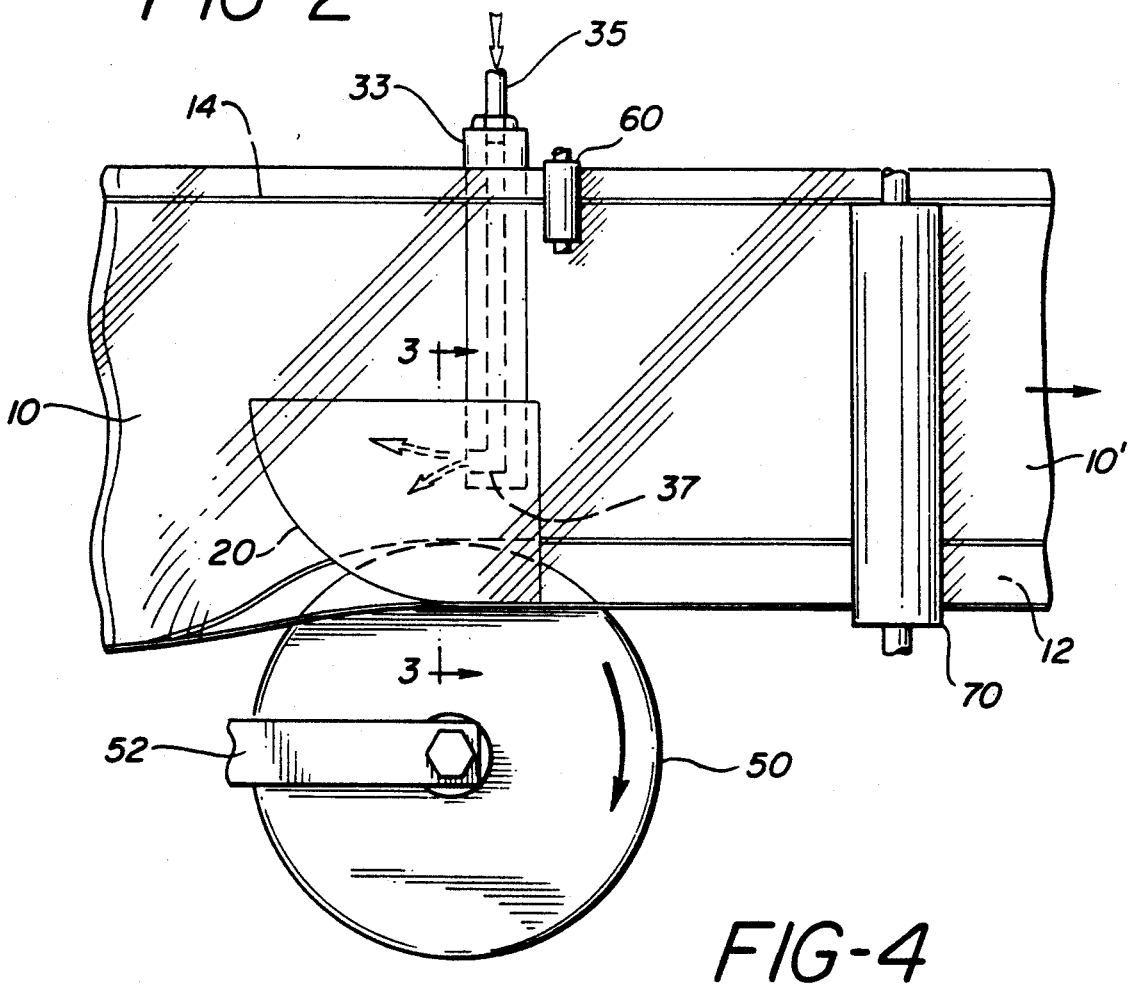
FIG. 2 is a fragmentary plan view of the apparatus of FIG. 1 forming a pleat in an advancing film web.

Referring now to FIGS. 1 and 2, an apparatus, shown generally at 15, for introducing a pleat 12 into a sequentially advancing, substantially continuous U-folded web 10 of plastic film to form a gusseted web 10' is provided. The apparatus includes receiving plates 20, a support bar 33 for supporting receiving plates 20 in a spaced apart position, a protruding plate or gusseting wheel 50, and a pair of nip rolls 70 downstream from the apparatus to flatten the web again after pleating. While gusseting wheel 50 is illustrated as being rotatably mounted, it will be apparent that other fixed plates or protruding structures may also be utilized to form pleat 12.

One reason for the U-folded web to block to itself is that the web passes through one or more sets of closely spaced rolls located upstream from pleating apparatus 15. Rolls 65, as depicted in FIG. 1, show a typical arrangement of rolls which may be positioned upstream from the pleating apparatus. Web 10 is pulled through pleating apparatus 15 by drive rolls (not shown) located downstream from the apparatus.

As shown in the drawing figures, web 10 includes a zipper 14 which typically includes complementary rib and groove fastener profiles on opposing faces of the web 10. Such zipper profiles are known in the art, and may take any of a number of known configurations. Where a zippered web is used in the apparatus, a zipper profile guide 16 is preferably used on support bar 33 to laterally align the zipper as the web is driven over the apparatus. Additionally, zipper closure rolls 60 are provided to join the complementary closure profiles once pleat 12 has been formed in the web.

Receiving plates 20 are usually two in number; however, there can be additional spaced apart plates depending upon the desired configuration of pleat 12. Plates 20 are generally parallel to one another and are secured in position by a generally rigid support bar 33. Bar 33 is preferably comprised of metal, but may be made of any suitably rigid material including a hard plastic or wood.

Gusseting wheel 50 which forms pleat 12 in web 10 is typically one in number; again, however, there may be additional wheels depending on the desired configuration of pleat or gusset 12. For example, there may be three receiving plates 20 and two corresponding gusseting wheels 50 to form a pair of pleats in web 10. Other combinations are possible. Gusseting wheel 50 is rotatably mounted between support brackets 52.

As shown, gusseting wheel 50 is generally parallel to and equidistant from receiving plates 20, and protrudes to some degree therebetween. The extent of protrusion by gusseting wheel 50 and the spacing of receiving plates 20 determine the width of pleat 12 taken in web 10. After further processing, including heat sealing and severing of individual bags (not shown) the gusset formed by the apparatus of the present invention will unfold to form a generally flat, planar surface for supporting the finished bag in an upright position for filling and storing.

Figure 3:
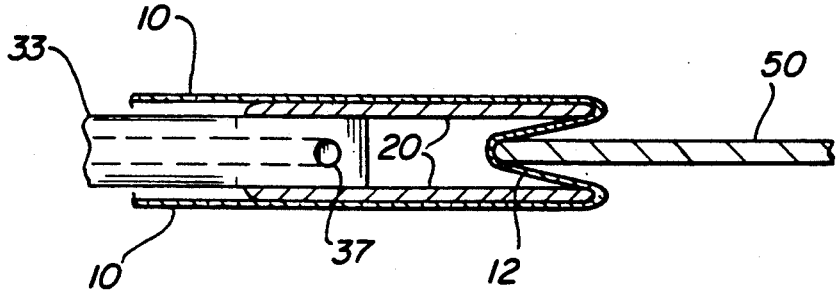
FIG. 3 is a fragmentary cross-sectional view taken along line 3—3 in FIG. 2 illustrating the cooperation among the receiving plates, pleating wheel, and film web.

Receiving plates 20 are positioned inside web 10 contiguous to the interior faces of the U-folded web 10 as illustrated. As best shown in FIG. 3, gusseting wheel 50 is positioned contiguous to the exterior surface of the U-folded edge portion of web 10 to be pleated such that web 10 follows the surface of protruding gusset wheel 50 into the space between receiving plates 20.

Preferably, both receiving plates 20 and gusseting wheel 50 are constructed of metal, although any rigid material such as a hard plastic or finished wood could be utilized. Also, preferably, the configuration of gusseting wheel 50 is as shown, which is a thin, generally circular protruding structure. However, other configurations may be used including elliptical or oblong-shaped structures capable of forming pleat 12 without damaging the physical integrity of web 10 as it passes. Again, the size of gusseting wheel 50 is not critical so long as it is of sufficient length, width, or radius to form the desired depth of tuck for pleat 12.

Receiving plates 20 are also preferably shaped as illustrated in a gull wing configuration. However, it is possible to use other shapes such as rectangles, squares, semicircular, elliptical, or oblong shapes which are capable of forming, in conjunction with gusseting wheel 50, pleat 12 in web 10 without damaging the physical integrity of the web. Any corners or edges coming into contact with web 10 are preferably rounded and smoothed to reduce any tendency for the web to hang up or tear. Again, the size of receiving plates 20 is not critical so long as they are of sufficient length and width to cooperate with gusseting wheel 50 to form pleat 12 of the desired depth of tuck.

As illustrated, web 10 approaches the pleating apparatus of the present invention in a U-folded configuration in which opposing faces of the web are contiguous. The opposing faces of the web must be separated as the web is driven over receiving plates 20 at rates well in excess of 100 feet per minute in order for pleat 12 to be taken in the web. In the past, the opposing faces of web 10 have tended to block to one another causing separation problems at receiving plates 20 and resulting in situations in which the web becomes hung up, misaligned, or torn during pleating.

This blocking problem is due to many factors including the natural tendency of thin films of thermoplastic such as polyethylene to stick to one another and the fact that the U-folded web may be stored on rolls in that configuration for extended time periods. Additionally, the web faces are brought together by closely spaced rolls, such as rolls 65, which press the faces of the web together, and static charges may develop which contribute to the tendency of the web faces to block to each other.

The apparatus of the present invention provides a means to separate the web faces prior to pleating which substantially reduces the problems which plagued previous pleating apparatuses. Support bar 33, which is positioned between receiving plates 20, includes an air passage 37 which is connected to a source of air under positive pressure (not shown) through air supply line 35. As web 10 is driven over receiving plates 20, air under pressure is directed between opposing faces of web 10 to separate and unblock them prior to pleat 12 being taken in the web.

Air passage 37 may be drilled through support bar 33. Alternatively, support bar 33 may be hollow, and air passage 37 may take the form of a tube which extends through the hollow interior of the support bar. Additionally, while only a single orifice or outlet is shown, plural or multiple orifices are within the scope of the invention.

As shown, preferably air passage 37 directs the air upstream toward the opposing faces of the web. However, the purpose of the air is to provide at least a partial inflating effect on the web so that so long as sufficient air is provided to the interior of the web, the faces will separate in the manner intended. It is not necessary to totally inflate the web. Partial inflation to separate the opposing faces has been found to be sufficient and avoids air removal problems downstream from the pleating apparatus at nip rolls 70.

It has been found that supplying air under a slight positive pressure at a rate of at least about 0.5 $ft^3$/min through a ⅛ inch diameter air passage provides sufficient air to the interior of the web to unblock and separate the web faces. The optimum rate of flow for the air depends, in part, on the rate at which air leaks out of the U-folded web around support bar 33. This rate of air leakage itself depends on the positioning of closure rolls 60 downstream from support bar 33 and the distance prior to support bar 33 at which zipper 14 opens. Preferably, air is supplied at a rate which approximates the amount of air which continuously leaks out of the web around support bar 33. Preferably, the source of air is regulatable through a valve or similar device so that an optimum flow rate may be maintained.

As shown, preferably there is a means provided for maintaining zipper 14 laterally stationary and in alignment at the point at which pleat 12 is introduced into the web. By laterally stationary and in alignment it is meant that the zipper will travel in substantially the same path through the apparatus both before and after the introduction of pleat 12 into the web.

Figure 4:
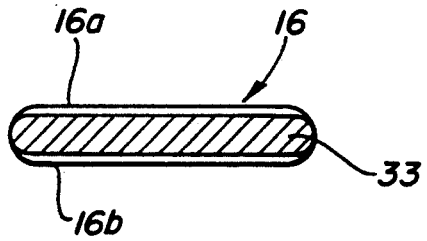
FIG. 4 is a cross-sectional view of the zipper profile guide on support bar 33.

FIG. 4 illustrates a preferred means for maintaining zipper 14 laterally stationary and in alignment which comprises a zipper profile guide 16 which forms a portion of support bar 33. Zipper profile guide 16 includes shallow, narrow pathways **16*a* and 16*b* traversing the upper and lower surfaces of support bar 33 in the machine direction. The complementary rib and groove closure profiles on web 10 are separated at profile guide 16 and guided and held in alignment along pathways 16*a* and 16*b*, which are retentionally coextensive therewith. Subsequently, the closure profiles are interlocked again by a pair of closely spaced closure rolls 60 through which the respective rib and groove profile elements of zipper 14 are passed. The separation and maintenance of alignment of respective closure profiles of zipper 14 are desirable to insure alignment of film web 10, even depth of pleat 12, and the symmetry of pleat 12 as it is being introduced into web 10**.

In operation, a pleat 12 is introduced into an advancing, substantially continuous, folded-over web 10 of plastic film having a zipper 14 with rib and groove profiles by advancing opposing faces of the film web 10 over a pair of substantially aligned and spaced-apart receiving plates 20. As the web 10 advances, a flow of air is directed from air passage 37 between the opposing faces of the film web to separate the opposing faces of the web prior to passing over receiving plates 20. Pleat 12 is formed in the folded-over web of film by tucking the edge of the folded-over web inwardly between receiving plates 20 using gusseting wheel 50 while maintaining the zipper 14 in lateral alignment.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. Apparatus for introducing a pleat into an advancing, substantially continuous, folded-over web of plastic film comprising:

a pair of substantially aligned and spaced-apart receiving plates positioned inside said film web over which opposing faces of said film web pass;

means positioned between said receiving plates and extending into the space therebetween for forming a pleat in said folded-over film;

means positioned between said receiving plates for directing a flow of air between said opposing faces of said web prior to passing over said receiving plates; and means for supporting said receiving plates in a spaced apart position;

in which said support means comprises a support bar; and in which said support bar includes an orifice therethrough for supplying air to the area between said receiving plates.

2. The apparatus of claim 1 in which the end of said orifice in said support bar directs air upstream toward said opposing faces of said advancing film web.

3. Apparatus for introducing a pleat into an advancing, substantially continuous, folded-over web of plastic film comprising:

a pair of substantially aligned and spaced-apart receiving plates positioned inside said film web over which opposing faces of said film web pass;

means positioned between said receiving plates and extending into the space therebetween for forming a pleat in said folded-over film; and means positioned between said receiving plates for directing a flow of air between said opposing faces of said web prior to passing over said receiving plates;

in which said means for forming a pleat is a generally circular-shaped wheel.

4. Apparatus for introducing a pleat into an advancing, substantially continuous, folded-over web of plastic film having a zipper with rib and groove profiles on opposing faces thereof comprising:

a pair of substantially aligned and spaced-apart receiving plates over which said opposing faces of said film web pass;

means positioned between said receiving plates and extending into the space therebetween for forming a pleat in said folded-over film;

means for laterally aligning said rib and groove profiles of said zipper during pleating of said web; and means positioned between said receiving plates for directing a flow of air between said opposing faces of said film web to separate said opposing faces of said web prior to passing over said receiving plates.

5. The apparatus of claim 4 in which said means for directing said flow of air comprises a source of air under pressure and means for supplying said air to the area between said receiving plates.

6. The apparatus of claim 4 further including means for supporting said receiving plates in a spaced apart position.

7. The apparatus of claim 6 in which said support means comprises a support bar.

8. The apparatus of claim 4 in which said means for forming a pleat is a generally circular-shaped wheel.

9. The apparatus of claim 4 including a pair of closely spaced rolls positioned upstream from said receiving plates.

10. The apparatus of claim 4 including a pair of nip rolls positioned downstream from said receiving plates for expelling air from said web and flattening it.

11. Apparatus for introducing a pleat into an advancing, substantially continuous, folded-over web of plastic film having a zipper with rib and groove profiles on opposing faces thereof comprising:

a pair of substantially aligned and spaced-apart receiving plates over which said opposing faces of said film web pass;

means positioned between said receiving plates and extending into the space therebetween for forming a pleat in said folded-over film;

means for supporting said receiving plates in a spaced apart position, said means comprising a support bar including an orifice therethrough for supplying air to the area between said receiving plates;

means for laterally aligning said zipper during pleating of said web; and means positioned between said receiving plates for directed a flow of air between said opposing faces of said film web to separate said opposing faces of said web prior to passing over said receiving plates.

12. The apparatus of claim 11 in which the end of said orifice in said support bar directs air upstream toward said opposing faces of said advancing film web.

* * * * *